US009132459B2

(12) United States Patent
Iogna Prat et al.

(10) Patent No.: US 9,132,459 B2
(45) Date of Patent: Sep. 15, 2015

(54) ADJUSTMENT DEVICE FOR GUIDE ROLLERS AND RELATIVE ADJUSTMENT METHOD

(75) Inventors: Emanuele Iogna Prat, Buttrio (IT); Marco Di Giacomo, Cormons (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 1110 days.

(21) Appl. No.: 13/141,612

(22) PCT Filed: Dec. 21, 2009

(86) PCT No.: PCT/EP2009/067626
§ 371 (c)(1),
(2), (4) Date: Jun. 22, 2011

(87) PCT Pub. No.: WO2010/072707
PCT Pub. Date: Jul. 1, 2010

(65) Prior Publication Data

US 2011/0259071 A1 Oct. 27, 2011

(30) Foreign Application Priority Data

Dec. 22, 2008 (IT) ..... UD2008A0267

(51) Int. Cl.
*B21B 39/16* (2006.01)
*B21B 19/12* (2006.01)

(52) U.S. Cl.
CPC ..... *B21B 39/165* (2013.01); *B21B 19/12* (2013.01)

(58) Field of Classification Search
CPC ..... B21B 39/008; B21B 39/06; B21B 39/14; B21B 39/16; B21B 39/00; B21C 1/00; B23B 31/00; F16H 19/00; F16H 25/00
USPC ..... 72/133, 227, 250, 251, 428, 450, 42
See application file for complete search history.

(56) References Cited

U.S. PATENT DOCUMENTS

| | | | | |
|---|---|---|---|---|
| 2,092,480 A | | 9/1937 | Talbot | |
| 2,976,749 A | * | 3/1961 | Albedyhl | 72/251 |
| 4,220,034 A | * | 9/1980 | Pogonowski | 72/399 |
| 4,483,169 A | * | 11/1984 | Jahr et al. | 72/250 |
| 6,209,378 B1 | | 4/2001 | Bradshaw | |

FOREIGN PATENT DOCUMENTS

| | | |
|---|---|---|
| EP | 0143523 | 6/1985 |
| EP | 0192386 | 8/1986 |

* cited by examiner

*Primary Examiner* — Shelley Self
*Assistant Examiner* — Lawrence Averick
(74) *Attorney, Agent, or Firm* — Hamre, Schumann, Mueller & Larson, P.C.

(57) ABSTRACT

An adjustment device and method to guide a metal product along a determinate nominal rolling axis. The device comprises a central body disposed astride the rolling axis, two guide units mounted movable on the central body, opposite each other with respect to the rolling axis and each provided with at least a guide roller for the metal product, and an adjustment mechanism mounted on the central body and operatively connected to both the guide units, in order to actuate the selective movement thereof with respect to the central body at least in an approach toward the rolling axis. The adjustment mechanism comprises a system of pantograph levers having two levers pivoted to each other and to the central body in correspondence to the rolling axis by means of a pin, and first constraint means disposed on each lever on opposite sides to the pin, so as to connect each lever to both the guide units.

11 Claims, 2 Drawing Sheets

ADJUSTMENT DEVICE FOR GUIDE ROLLERS AND RELATIVE ADJUSTMENT METHOD

FIELD OF THE INVENTION

The present invention concerns a device, and relative method, to adjust the position of relative guide rollers used to convey a metal product between two work rolls of a rolling stand, during hot- or cold-rolling operations. In particular the present invention is applied to move the guide rollers coordinately, in order to guarantee the correct centered position of the metal product with respect to the axis of the rolling channel defined by the work rolls.

BACKGROUND OF THE INVENTION

In the field of rolling, the need to correctly direct the metal product entering between the work rolls of a rolling stand is known.

This need is even more urgent in the case of rolling long products such as bars, metal wire or other, in which the work rolls are shaped in a coordinate and complementary way to the section of the rolled product.

Generally, to guarantee the centering of the rolled product with respect to the rolling channel defined by the work rolls, it is known to provide guide rollers, disposed upstream of the rolling stand, with respect to the advance of the metal product.

Such guide rollers are disposed opposite each other with respect to a nominal rolling axis, and tend to maintain the metal product along this axis, as it enters between the work rolls.

Solutions are also known in which the position of the guide rollers is adjustable, with respect to the rolling axis, depending on the dimensions of the metal product, and/or possible variations in the operating conditions.

It is known to move each guide roller independently by means of a specific actuator.

This known solution has considerable disadvantages in the coordination of the actuators, with greater inaccuracies of positioning and centering of the metal product with respect to the work rolls and to the rolling axis.

It is also known to connect the guide rollers in pairs or threes on one side or the other with respect to the rolling axis, so as to provide a common actuator for each pair or threesome.

However, this known solution, as well as having disadvantages connected to the coordination of the actuators, in any case does not guarantee a sufficiently accurate centering of the metal product with respect to the rolling axis, since it has to provide independent feeds for the actuators.

Solutions in which the guide rollers are assembled movable with respect to a body are also known, as in European patent EP-B-0143523, in which they are simultaneously movable by means of a common adjustment mechanism, in a direction inclined with respect to the rolling axis.

In this type of known solution, the movement of the rolling rolls, which occurs in an inclined direction with respect to the axis, is not easily controllable and predictable, in that the final position of the guide rollers depends, on each occasion, on different geometric factors, among which the angle of movement, the actual size of the metal product and others.

This solution is thus difficult to operate and manage, and has high manufacturing costs due mainly to the need to provide inclined guides or conical parts mating with each other, with complex actuation mechanisms.

Moreover, some of the known solutions provide the need to temporarily disassemble the adjustment device with respect to the rolling line, to carry out the adjustment of the reciprocal position of the guide rollers. This known operating mode entails long equipping times and possible inaccuracies in the in line re-positioning of the adjustment device.

One purpose of the present invention is to achieve an adjustment device for guide rollers which is both simple and economical, which is easy to manage, and which allows to obtain an efficient and precise adjustment, guaranteeing the correct centered positioning of the metal product with respect to the rolling channel defined by the work rolls.

Another purpose of the present invention is to achieve an adjustment device for guide rollers which allows to carry out the adjustment of the position of the guide rollers even keeping the device in line on the adjustment plant.

Another purpose of the present invention is to perfect a method which allows an efficient and precise adjustment, guaranteeing the correct centered positioning of the metal product with respect to the work rolls.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, an adjustment device and method for guide rollers according to the present invention is applied to guide a metal product along a determined rolling axis, for example, inside the rolling channel defined by the work rolls of a rolling stand.

The device according to the present invention comprises a central body disposed astride the rolling axis, and at least two guide units, or roll bearers, mounted movable on the central body, opposite each other with respect to the nominal rolling axis and each provided with at least a guide roller for the metal product.

The device according to the present invention also comprises an adjustment mechanism mounted on the central body and operatively connected to both the guide units, in order to actuate the selective movement thereof with respect to the central body at least in an approach with respect to the nominal rolling axis.

According to a characteristic feature of the present invention the adjustment mechanism comprises a system of pantograph levers, in which at least two levers are pivoted to each other centrally and to the central body in correspondence to the rolling axis.

The device according to the invention also comprises first constraint means disposed on each lever on opposite sides to the pivoting point in order to connect the relative lever to both guide units.

In this way, when they are driven, there is a rotation in an opposite direction of the two levers around their pivoting point, so as to cause the reciprocal, simultaneous and specular movement of the two guide units with respect to the rolling axis.

With the present invention, the guide rollers both move by the same amount with respect to the nominal rolling axis, thus guaranteeing an effective, constant and precise adjustment of the distance between the two guide rollers, and guaranteeing a correct, centered positioning of the metal product with respect to the rolling axis.

Furthermore, the displacement of the rollers takes place in a direction that is always orthogonal to the nominal rolling axis.

Furthermore, given the mechanical simplicity of the adjustment mechanism, the management and maintenance thereof, if any, are simplified with respect to the state of the art.

According to a variant, motion conditioning means are provided, made partly on the central body and partly on each guide unit, disposed in cooperation with the first constraint means and reciprocally conformed to transform the rotation of the levers in the opposite direction into a linear movement of the guide units, substantially orthogonal with respect to the rolling axis.

In this way it is possible to determine in advance, and with greater accuracy, the final positioning of the guide rollers on the metal product, without considering factors connected to the inclination of the movement or other.

According to a variant, the adjustment mechanism comprises a common actuator member for both levers.

According to a variant, the actuator member is constrained to the respective levers by means of second constraint means.

According to a variant, the actuator member is constrained to the respective levers directly by means of the first constraint means.

In any case, the common actuator member, since there is only one to move both levers, provides only one feed with a consequent simplification of design, assembly and operating management.

According to another variant, the common actuator member comprises a threaded element connected mechanically by means of relative movement bushings to both levers, to move them simultaneously.

According to another variant, the common actuator member comprises a hydraulic cylinder with a double rod.

According to a variant, the device comprises recovery means, for example elastic, disposed in cooperation with the levers, and able to recover possible plays between the parts.

In this way, the functional precision of the device is increased.

According to another variant, each guide unit comprises a support bar on which two guide rollers are rotatably mounted.

According to another variant, the two guide rollers can have different heights, or more generally, different sizes, and grooves or other marks may be provided on the relative external circular surfaces, depending on the type of metal product to be rolled.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF SOME PREFERENTIAL FORMS OF EMBODIMENT

Figure 1:
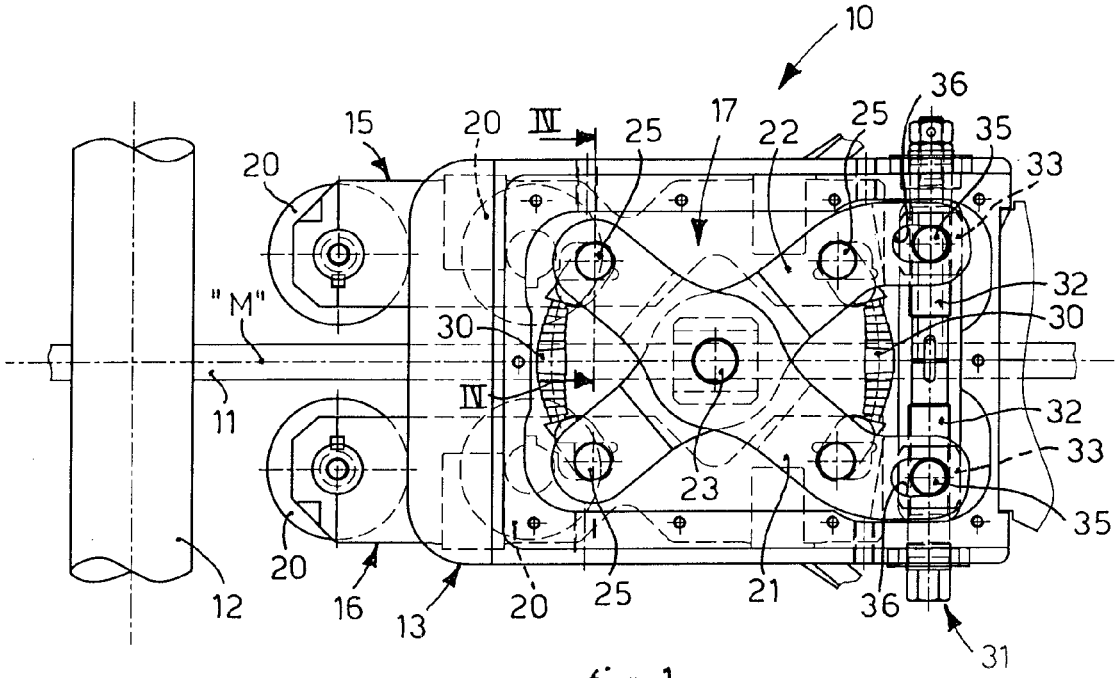
FIG. 1 shows a view from below of an adjustment device according to the present invention in a first operating condition.

With reference to the attached drawings, an adjustment device 10 according to the present invention can be installed upstream of a rolling stand to convey a metal product 11 between two work rolls 12 of said rolling stand, along a determinate nominal rolling axis "M".

The adjustment device 10 according to the invention comprises a central body 13, two roll bearers 15 and 16, or guide units, and an adjustment mechanism 17.

The central body 13 is hollow axially in through manner, so as to allow the metal product 11 to pass inside it.

Advantageously, the central body 13 is positioned substantially astride the rolling axis M, so that the latter substantially coincides with a median longitudinal axis of the axial cavity of the central body 13.

The roll bearers 15 and 16 are mounted movable on the central body 13, on opposite sides with respect to the rolling axis M.

Each roll bearer 15, 16 comprises a support bar 19 mounted movable laterally to the central body 13 and two guide rollers 20 mounted rotatable on the support bar 19 and shaped to cooperate laterally with the metal product 11 and to condition the centering thereof with respect to the rolling axis M.

The adjustment mechanism 17 comprises a system of pantograph levers, in this case having a first lever 21 and a second lever 222 substantially specular to the first lever 21.

The two levers 21 and 22 are pivoted to each other and to the central body 13 by means of a pin 23.

In particular, the position of the pin 23 with respect to the central body 13 is substantially in correspondence with the rolling axis M.

Furthermore, the reciprocal position of the two levers 21 and 22 is such that they are pivoted to each other in substantially median reciprocal segments, so as to be specular and discordant in their rotation with respect to the pin 23.

Each lever 21 and 22 is constrained to the support bars 19 of both roll bearers 15 and 16 on opposite sides with respect to the pin 23.

Figure 4:
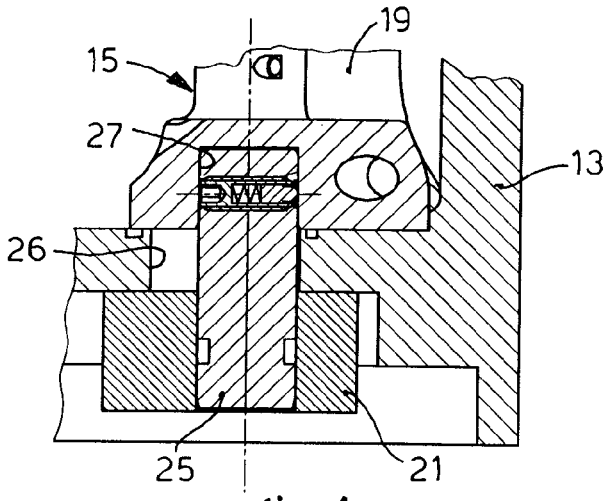
FIG. 4 shows a section from IV to IV of FIG. 1.

In particular, each constraint in this case is defined by a constraint block 25, on one side, attached to the relative lever 21, 22, and on the other side mounted movable on the relative support bar 19 (FIG. 4).

Each pin 23 is inserted into relative conditioning eyelets, respectively a first 26 and a second 27.

The first conditioning eyelet 26 is made through on the central body 13, to allow the relative block 25 to reach the support bar 19.

The second conditioning eyelet 27 is made blind on the relative support bar 19.

The second conditioning eyelet 27 comprises at least a rectilinear edge 29 oriented substantially parallel to the rolling axis M, and against which the constraint block 25 is able to cooperate during the rotation of the levers 21 and 22.

In this case, the two levers 21 and 22 are connected to each other in proximity with the constraint blocks 25 by two compression springs 30, which tend to keep the levers 21 and 22 in a reciprocally spread condition (FIG. 1).

The compression springs 30 have an at least partial function of recovering the constructional plays between the parts of the adjustment mechanism 17.

The adjustment mechanism 17 also comprises an actuator member 31, in this case a screw, which has two threaded segments 32 with respect to which two movement bushings 33 slide due to screwing.

The two threaded segments 32 advantageously have the same thread pitch, but with an opposite direction, so that a complete turn of each segment corresponds to an equivalent and discordant movement of the movement bushings 33.

The compression springs 30 also have the function of recovering the plays of the threaded segments 32.

Each movement bushing 33 is connected by means of a constraint block 35 to a relative lever 21, 22.

In particular, each constraint block 35 slides in a correlated eyelet 36 provided on the relative lever 21, 22.

The adjustment device 10 as described heretofore functions as follows.

Starting from a first spread condition of the levers 21 and 22 (FIG. 1), the actuator member 31 is actuated by screwing, so as to simultaneously move the movement bushings 33 which will in turn move their constraint block 35.

This movement determines the discordant rotation of the levers 21 and 22 with respect to the pin 23, so that the movement is determined of the constraint blocks 25 inside the relative conditioning eyelets 26 and 27.

Figure 3:
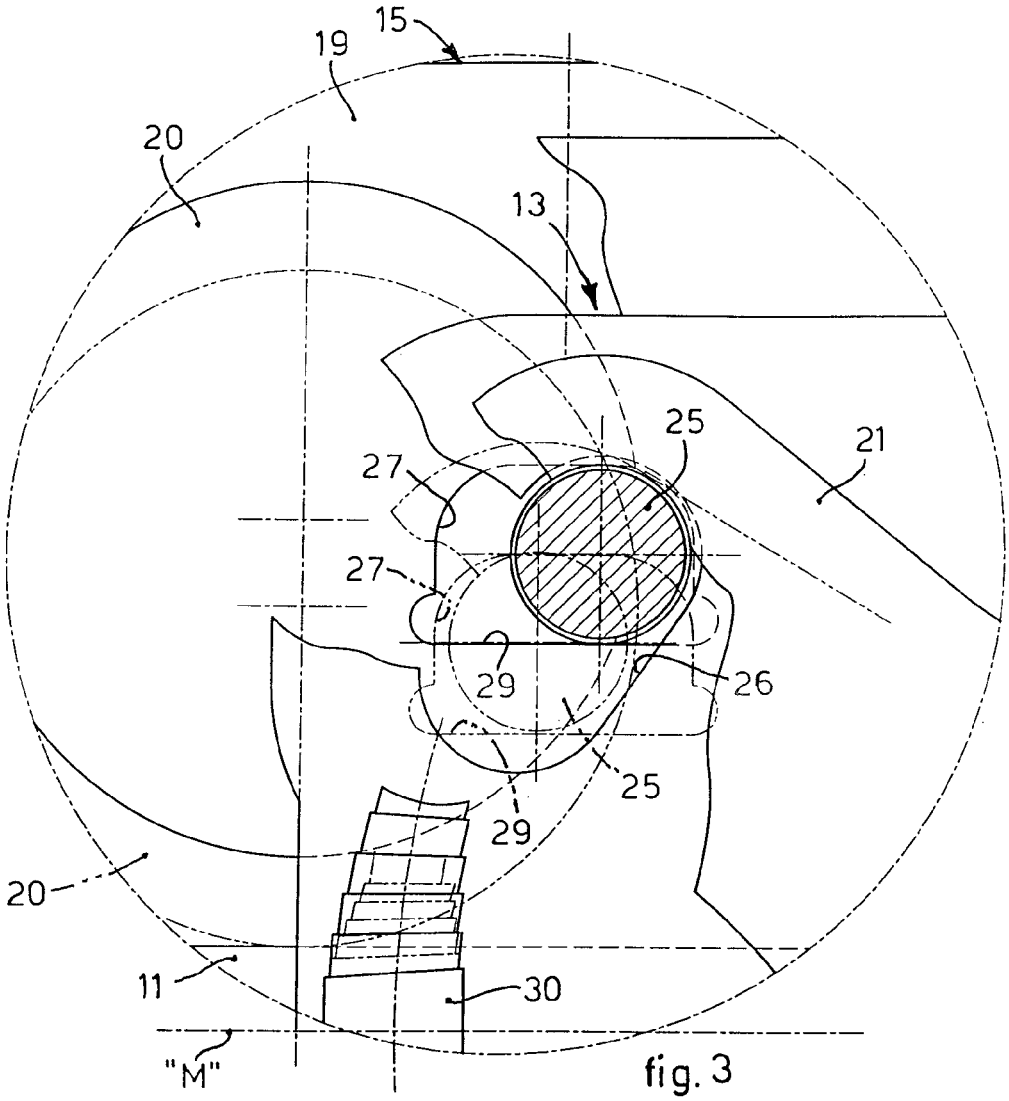
FIG. 3 shows an enlarged and partly sectioned detail of the device in FIG. 1.

With particular reference to FIG. 3, it should be noted how the cooperation between the constraint block 25 with the first conditioning eyelet 26 and with the second conditioning eyelet 27, in particular with the rectilinear edge 29 of the latter, determines a movement of the support bar 19 and the guide rollers 20, substantially rectilinear and orthogonal to the rolling axis M.

Figure 2:
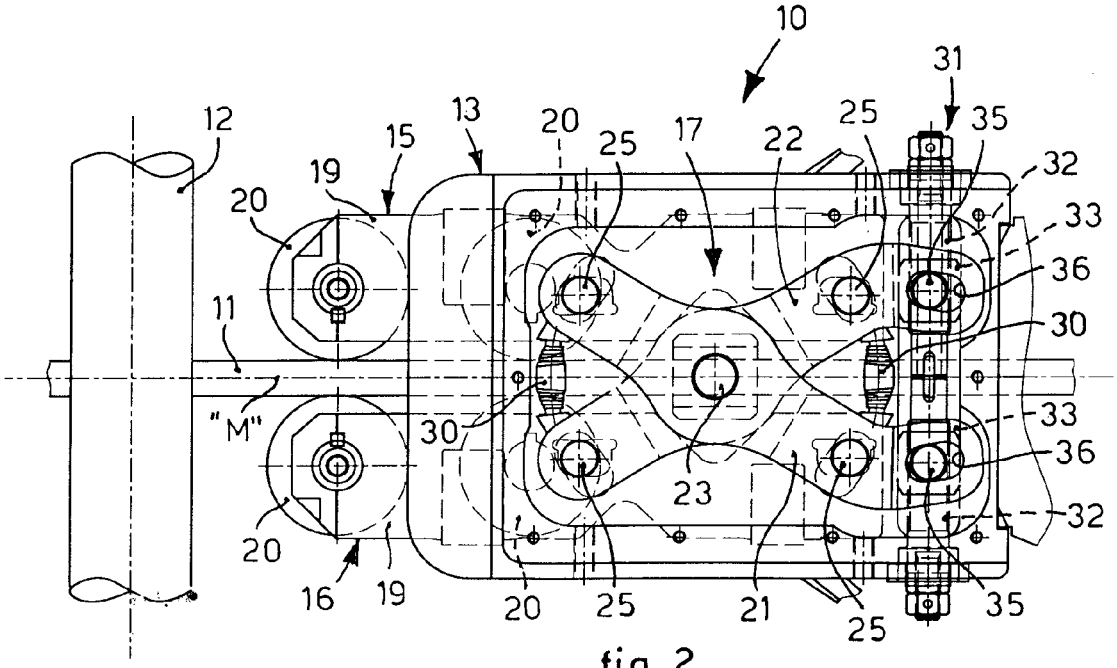
FIG. 2 shows a view from below of an adjustment device according to the present invention in a second operating condition.

We therefore have a substantially orthogonal and symmetrical movement of the guide rollers 20 with respect to the metal product 11. This movement is actuated until contact is made by the guide rollers 20 on the metal product 11 (FIG. 2), guaranteeing the centering thereof with respect to the rolling axis M.

Possible further adjustment and/or settings of the position can be made simply by acting on the single actuator member 31.

It is clear, however, that modifications and/or additions of parts or steps may be made to the adjustment device 10 and the relative method as described heretofore, without departing from the field and scope of the present invention.

For example, it comes within the field of the present invention to provide that instead of the screw type actuator member 31 a double rod oil-dynamic actuator is provided.

According to another variant, the movement of the support bar 19 can be conditioned, instead of with two conditioning eyelets 26 and 27, by other levers suitably disposed and constrained to the two levers 21 and 22, to transform the rotation motion of the latter into a linear motion of the support bar 19.

According to another variant, instead of the compression springs 30, other elastic means may be provided, suitably disposed so as to recover the construction plays of the parts.

According to another variant, in particular if an extensive adjustment travel is provided of the two roll bearers 15, 16, the first conditioning eyelet 26 has an arched shape and its median longitudinal axis defines an arc centered in correspondence with the axis of rotation of the levers 21, 22 around the pin 23.

It also comes within the field of the present invention to provide that the actuator member 31 is constrained to the levers 21 and 22 directly by means of the constraint block 25 that constrain the levers 21, 22 to the respective support bars 19.

It is also clear that, although the present invention has been described with reference to specific examples, a person of skill in the art shall certainly be able to achieve many other equivalent forms of adjustment device for guide rollers and relative adjustment method, having the characteristics as set forth in the claims and hence all coming within the field of protection defined thereby.

The invention claimed is:

1. An adjustment device to guide a metal product along a determinate nominal rolling axis, said adjustment device comprising:

a central body disposed astride the rolling axis;

at least two guide units mounted movable on said central body, opposite each other with respect to the rolling axis and each provided with at least a guide roller for the metal product; and an adjustment mechanism mounted on said central body and operatively connected to both said guide units, in order to actuate the selective movement thereof with respect to said central body at least in an approach toward the rolling axis, wherein said adjustment mechanism comprises a system of pantograph levers having at least two levers pivoted to each other and to said central body in correspondence to the rolling axis by a pinning device, and constraint devices disposed on each lever on opposite sides of said pinning device, so as to connect each lever to both said guide units.

2. The adjustment device as in claim 1, comprising a motion conditioning device, made partly on said central body and partly on each guide unit, disposed in cooperation with said constraint devices, and reciprocally conformed so as to transform the movement of said levers into a movement of said guide units, substantially orthogonal with respect to said rolling axis.

3. The adjustment device as in claim 2, wherein said motion conditioning device comprises a first conditioning eyelet made through on said central body, and a second conditioning eyelet made on the relative guide unit.

4. The adjustment device as in claim 3, wherein said first conditioning eyelet has an arched shape and the median longitudinal axis thereof defines an arc centered in correspondence with the pivoting axis of said levers around said pin.

5. The adjustment device as in claim 3, wherein said second conditioning eyelet comprises at least a rectilinear edge oriented substantially parallel to the rolling axis.

6. The adjustment device as in claim 1, wherein said adjustment mechanism comprises an actuator member common to both said levers.

7. The adjustment device as in claim 6, wherein said actuator member is constrained to the respective levers by said constraint devices.

8. The adjustment device as in claim 6, wherein said actuator member comprises at least a threaded element mechanically connected by relative movement bushings to both said levers, in order to move them simultaneously.

9. The adjustment device as in claim 2, comprising a recovery device disposed in cooperation with both said levers, and able to recover possible plays between the parts.

10. The adjustment device as in claim 3, wherein each of said guide units comprises at least a support bar on which two guide rollers are rotatably mounted.

11. An adjustment method to guide a metal product along a determinate nominal rolling axis, using a device comprising a central body disposed astride the rolling axis, at least two guide units mounted movable on said central body, opposite each other with respect to the rolling axis and each provided with at least a guide roller for the metal product, and an adjustment mechanism mounted on said central body and operatively connected to both said guide units, the method comprising at least an adjustment step in which the selective movement of said guide units occurs by actuating with respect to said central body a system of pantograph levers of said adjustment mechanism, said system having at least two levers pivoted to each other and to said central body in correspondence with the rolling axis by a pinning device, and constraint devices disposed on each lever on opposite sides to said pinning device, so as to connect each lever to both said guide units.

* * * * *